US010813471B2

(12) United States Patent
Lakey

(10) Patent No.: US 10,813,471 B2
(45) Date of Patent: Oct. 27, 2020

(54) INFANT HOLSTER

(71) Applicant: Amanda Lakey, Durango, CO (US)

(72) Inventor: Amanda Lakey, Durango, CO (US)

( * ) Notice: Subject to any disclaimer, the term of this patent is extended or adjusted under 35 U.S.C. 154(b) by 0 days.

(21) Appl. No.: 16/361,663

(22) Filed: Mar. 22, 2019

(65) Prior Publication Data

US 2020/0297128 A1 Sep. 24, 2020

(51) Int. Cl.
*A47D 13/02* (2006.01)

(52) U.S. Cl.
CPC ..... *A47D 13/02* (2013.01)

(58) Field of Classification Search
CPC ..... A47D 13/025; A47D 15/00; A45F 3/04; A45F 2003/045; A45F 3/08
See application file for complete search history.

(56) References Cited

U.S. PATENT DOCUMENTS 4,009,808 A * 3/1977 Sharp ..... A47D 13/025 224/160
4,428,514 A * 1/1984 Elf ..... A47D 13/025 224/155
5,205,450 A * 4/1993 Derosier ..... A47D 13/025 224/161
5,246,152 A * 9/1993 Dotseth ..... A47D 13/025 224/158
5,848,741 A * 12/1998 Fair ..... A47C 7/66 224/160
6,283,347 B1 * 9/2001 Roh ..... A47C 7/66 2/4
6,988,644 B1 * 1/2006 Asherbranner ..... A47D 13/025 224/160
8,172,116 B1 * 5/2012 Lehan ..... A45F 3/04 224/160
8,960,511 B2 * 2/2015 Shepherd ..... A45C 3/00 224/259
9,357,852 B2 * 6/2016 Salazar ..... A47D 13/025
9,949,575 B2 * 4/2018 Pond ..... A47D 13/025
2004/0164109 A1 * 8/2004 Hiscocks ..... A47D 13/025 224/160
2005/0258202 A1 * 11/2005 Stevens ..... A47D 13/025 224/159
2006/0076373 A1 * 4/2006 LaBelle ..... A45F 3/04 224/160
2006/0261104 A1 * 11/2006 Zambrzycki ..... A47D 13/02 224/158
2008/0283559 A1 * 11/2008 Parness ..... A47D 13/025 224/159
2009/0206116 A1 * 8/2009 Grant ..... A45F 3/08 224/160

(Continued)

*Primary Examiner* — Brian D Nash
(74) *Attorney, Agent, or Firm* — The Iwashko Law Firm, PLLC; Lev Ivan Gabriel Iwashko

(57) ABSTRACT

An infant holster to carry an infant on a portion of a body of a user in a water environment, the infant holster including a main body to brace the infant against at least a portion of the body of the user, the main body including a mesh pouch disposed on at least a center portion of the main body to permit water to flow in and out of the main body, and a top flap disposed along at least a portion of an edge of the main body to receive a head of the infant thereupon, and a plurality of shoulder straps disposed along at least a portion of a top edge of the top flap to suspend the main body in response to wearing the plurality of shoulder straps on shoulders of the user.

5 Claims, 1 Drawing Sheet

(56) References Cited

U.S. PATENT DOCUMENTS

| | | | | |
|---|---|---|---|---|
| 2011/0062195 | A1* | 3/2011 | Jones | A47D 13/025 224/161 |
| 2011/0174845 | A1* | 7/2011 | LaBelle | A47D 13/025 224/160 |
| 2011/0290831 | A1* | 12/2011 | Wang | A47D 13/025 224/160 |
| 2012/0241487 | A1* | 9/2012 | Zack | A47D 13/025 224/576 |
| 2012/0318833 | A1* | 12/2012 | Zack | A47D 13/025 224/160 |
| 2014/0263491 | A1* | 9/2014 | Telford | A47D 13/025 224/160 |
| 2015/0196133 | A1* | 7/2015 | Rosen | A47D 13/025 224/160 |
| 2019/0014920 | A1* | 1/2019 | Matsuyama | A47D 13/025 |

* cited by examiner

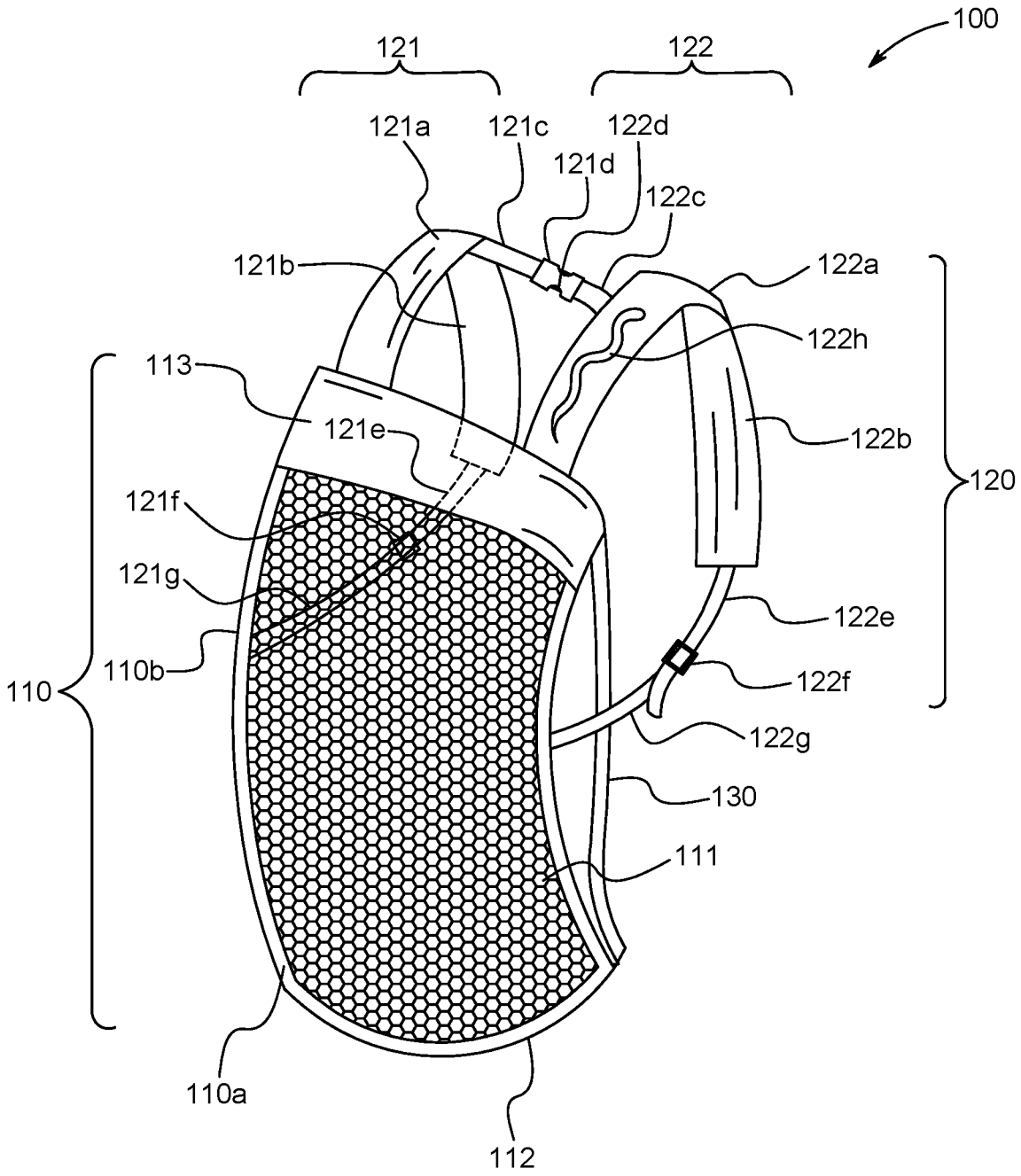
100
121
122
121a
121c
122d
121d
122c
121b
122a
122h
113
121e
122b
120
121f
121g
122e
110b
122f
110
122g
130
111
110a
112

INFANT HOLSTER

BACKGROUND

1. Field

The present general inventive concept relates generally to a holster, and particularly, to an infant holster.

2. Description of the Related Art

Various types of holsters, cradles, and other devices have been created to assist in transporting an infant, when the infant is unable to walk on its own. Very young infants that are not yet capable of walking, rely on parents to carry the infant for transportation from one location to another. This task gets to be quite a chore for any parent or guardian. Infant holsters have been developed to allow the placement of the infant into the holster, which is usually strapped around a user's shoulders. The holster allows the parent or caregiver to have complete use of both arms while the baby remains held within the holster.

One drawback to the infant holsters is that many times they are made of cloth or a material that is not necessarily conducive for use in water. Many parents enjoy placing or holding their infant in the water, so the infant can experience a pool or other water environment, such that the infant enjoys a water activity.

Therefore, there is a need for a holster to hold the infant while being transported by the parent in the water without the parent having to use hands to hold the infant.

SUMMARY

The present general inventive concept provides an infant holster.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an infant holster to carry an infant on a portion of a body of a user in a water environment, the infant holster including a main body to brace the infant against at least a portion of the body of the user, the main body including a mesh pouch disposed on at least a center portion of the main body to permit water to flow in and out of the main body, and a top flap disposed along at least a portion of an edge of the main body to receive a head of the infant thereupon, and a plurality of shoulder straps disposed along at least a portion of a top edge of the top flap to suspend the main body in response to wearing the plurality of shoulder straps on shoulders of the user.

The main body may further include a trim edge disposed around a perimeter of the main body to support the mesh pouch.

The plurality of shoulder straps may include a first shoulder strap to be worn on at least a portion of a first shoulder of the user, and a second shoulder strap to be worn on at least a portion of a second shoulder of the user.

The plurality of shoulder straps may further include a first adjustment strap disposed on at least a portion of the first shoulder strap; and a second adjustment strap disposed on at least a portion of the second shoulder strap to connect to the first adjustment strap to reduce movement of the first shoulder strap and the second shoulder strap, such that the plurality of shoulder straps do not fall off at least one of the shoulders of the user and cause the infant to fall out of the main body.

The plurality of shoulder straps may further include a receiving fastener disposed on an end of the first adjustment strap, and an inserting fastener disposed on an end of the second adjustment strap to removably connect the first adjustment strap to the second adjustment strap, such that the inserting fastener is inserted into the receiving fastener.

Each of the plurality of shoulder straps may include a first lower shoulder strap disposed on a distal end with respect to the top flap of each of the plurality of shoulder straps, and a second lower shoulder strap disposed on at least a portion of the main body to connect to the first lower shoulder strap to adjustably secure the infant against the body of the user.

Each of the plurality of shoulder straps may further include a fastener disposed between the first lower shoulder strap and the second lower should strap to receive at least a portion of the first lower shoulder strap and at least a portion of the second lower should strap therein, such that a length of each of the plurality of shoulder straps shortens in response to moving the first lower shoulder strap through the fastener in a first direction, and extends in response to moving the first lower shoulder strap through the fastener in a second direction.

The infant holster may further include a back strap to wrap around a back and a front of the user, such that the back strap redistributes a weight of the infant within the main body across at least a portion of the body of the user.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a front isometric view of an infant holster, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Infant Holster 100
Main Body 110
First Side 110*a*
Second Side 110*b*
Mesh Pouch 111
Trim Edge 112
Top Flap 113
Plurality of Shoulder Straps 120
First Shoulder Strap 121
First Side 121*a*
Second Side 121*b*
First Adjustment Strap 121*c*
Receiving Fastener 121*d*
First Lower Should Strap 121*e*
Fastener 121*f*
Second Lower Shoulder Strap 121*g*
Second Shoulder Strap 122
First Side 122*a*
Second Side 122*b*
Second Adjustment Strap 122*c*
Inserting Fastener 122*d*
First Lower Shoulder Strap 122*e*
Fastener 122*f*
Second Lower Shoulder Strap 122*g*
Indicia 122*h*
Back Strap 130

FIG. 1 illustrates a front isometric view of an infant holster 100, according to an exemplary embodiment of the present general inventive concept.

The infant holster 100 may be constructed from at least one of metal, plastic, cloth, and neoprene, etc., but is not limited thereto. The infant holster 100 may have a thin thickness, but may be durable and capable of supporting a weight of an infant. Moreover, the infant holster 100 may be waterproof and resistant to wear while being used in a water environment, such as a pool, an ocean, a river, a lake, and/or a pond, but is not limited thereto.

Additionally, the infant holster 100 may be constructed to have at least one color and/or a combination of colors as desired by a user.

The infant holster 100 may include a main body 110, a plurality of shoulder straps 120, and a back strap 130, but is not limited thereto.

The main body 110 may include a first side 110*a*, a second side 110*b*, a mesh pouch 111, a trim edge 112, and a top flap 113, but is not limited thereto.

Referring to FIG. 1, the main body 110 is illustrated to have a rectangular prism shape. However, the main body 110 may be a square prism, a circular prism, a pentagonal prism, a hexagonal prism, an octagonal prism, or any other shape known to one of ordinary skill in the art, but is not limited thereto.

The main body 110 may be of any predetermined size capable of retaining the infant therein while being worn by the user. In other words, the main body 110 may brace the infant against a portion of a body of the user. The mesh pouch 111 may be disposed on at least a center portion of the main body 110. Furthermore, the mesh pouch 111 may include a predetermined number of apertures disposed therein to permit water to flow through at least a portion thereof. As such, water may flow out of the main body 110 in response to the main body 110 being removed from the water environment, such that water may not accumulate between the infant and the user.

The trim edge 112 may be disposed around a perimeter of the main body 110 to create an edge around the main body 110, such that the user may grip at least a portion of the trim edge 112. In other words, the trim edge 112 may facilitate gripping at least a portion of the main body 110 by the user. Furthermore, the trim edge 112 may support the mesh pouch 111, such that the trim edge 112 may prevent the mesh pouch 111 from tearing.

The top flap 113 may be disposed along at least a portion of an edge of the main body 110 to receive at least a portion of the infant's head thereupon. In other words, the infant's head may rest on at least a portion of the top flap 113 on the second side 110*b* of the main body 110. Alternatively, the user may push and/or pull at least a portion of the top flap 113 to cover at least a portion of the infant's head.

The plurality of shoulder straps 120 may include a first shoulder strap 121 and a second shoulder strap 122, but is not limited thereto.

The first shoulder strap 121 may include a first side 121*a*, a second side 121*b*, a first adjustment strap 121*c*, a receiving fastener 121*d*, a first lower shoulder strap 121*e*, a fastener 121*f*, and a second lower shoulder strap 121*g*, but is not limited thereto.

The receiving fastener 121*d* may include a zipper, a buckle, a button, a snap, a clasp, a fastener, hooks and loops, etc., but is not limited thereto.

The fastener 121*f* may include a zipper, a buckle, a button, a snap, a clasp, a fastener, hooks and loops, etc., but is not limited thereto.

The first shoulder strap 121 may be disposed along at least a portion of a top edge of the top flap 113, such that the first shoulder strap 121 extends a predetermined distance away from the top flap 113. The first shoulder strap 121 may be worn on at least a portion of a first shoulder of the user. Specifically, the user may wear the first shoulder strap 121 by placing the second side 121*b* over at least a portion of the first shoulder to at least partially suspend the main body 110.

The first lower shoulder strap 121*e* may be disposed on a distal end of the shoulder strap 121 with respect to the top flap 113. The second lower shoulder strap 121*g* may be disposed on at least a portion of the main body 110. The fastener 121*f* may receive at least a portion of the first lower shoulder strap 121*e* and at least a portion of the second lower shoulder strap 121*g* therein.

Moreover, the user may adjust a length of the first shoulder strap 121 in response to moving the first lower shoulder strap 121*e* through the fastener 121*f*. More specifically, the user may shorten the length of the first shoulder strap 121 in response to moving the first lower shoulder strap 121*e* through the fastener 121*f* in a first direction or a second direction toward the main body 110, such that the first lower shoulder strap 121*e* may overlap the second lower shoulder strap 121*g*. Alternatively, the user may extend the length of the first shoulder strap 121 in response to moving the first lower shoulder strap 121*e* through the fastener 121*f* in the second direction or the first direction away from the main body 110, such that the first lower shoulder strap 121*e* may move away from the second lower shoulder strap 121*g*.

The second shoulder strap 122 may include a first side 122*a*, a second side 122*b*, a second adjustment strap 122*c*, an inserting fastener 122*d*, a first lower shoulder strap 122*e*, a fastener 122*f*, a second lower shoulder strap 122*g*, and an indicia 122*h*, but is not limited thereto.

The inserting fastener 122*d* may include a zipper, a buckle, a button, a snap, a clasp, a fastener, hooks and loops, etc., but is not limited thereto.

The fastener 122*f* may include a zipper, a button, a buckle, a snap, a clasp, a fastener, hooks and loops, etc., but is not limited thereto.

The second shoulder strap 122 may be disposed along at least a portion of the top edge of the top flap 113, such that the second shoulder strap 122 extends a predetermined distance away from the top flap 113. The second shoulder strap 122 may be worn on at least a portion of a second shoulder of the user. Specifically, the user may wear the second shoulder strap 122 by placing the second side 122*b* over at least a portion of the second shoulder to at least partially suspend the main body 110.

The first lower shoulder strap 122*e* may be disposed on a distal end of the shoulder strap 122 with respect to the top flap 113. The second lower shoulder strap 122*g* may be disposed on at least a portion of the main body 110. The fastener 122*f* may receive at least a portion of the first lower shoulder strap 122*e* and at least a portion of the second lower shoulder strap 122*g* therein.

Moreover, the user may adjust a length of the second shoulder strap 122 in response to moving the first lower shoulder strap 122*e* through the fastener 122*f*. More specifically, the user may shorten the length of the second shoulder strap 122 in response to moving the first lower shoulder strap 122*e* through the fastener 122*f* in a first direction or a second direction toward the main body 110, such that the first lower shoulder strap 122*e* may overlap the second lower shoulder strap 122*g*. Alternatively, the user may extend the length of the second shoulder strap 122 in response to moving the first lower shoulder strap 122*e* through the fastener 122*f* in the second direction or the first direction away from the main body 110, such that the first lower shoulder strap 122*e* may move away from the second lower shoulder strap 122*g*.

Referring to FIG. 1, the indicia 122*h* may include any design based on the user's preferences. For example, the indicia 122*h* may be a worm, but is not limited thereto. The indicia 122*h* is illustrated to be disposed on at least a portion of the first side 122*a* of the second shoulder strap 122. However, the indicia 122*h* may be disposed on at least a portion of the first side 121*a* of the first shoulder strap 121 and/or each of the plurality of shoulder straps 120.

The plurality of shoulder straps 120 may suspend the main body 110 in response to wearing the plurality of shoulder straps 120 on shoulders of the user. The user may insert the infant within the main body 110 subsequent to wearing the plurality of shoulder straps 120. Specifically, the user may place the second side 110*b* of the main body 110 against a portion of a body of the infant to hold the infant. The user may grasp at least a portion of the first side 110*a* of the main body 110 to adjust the main body 110 to comfort the infant. Subsequently, the user may shorten the length of the first shoulder strap 121 and/or the second shoulder strap 122 to adjustably secure the infant against the body of the user. As such, the infant may be adjustably secured against a portion of the body of the user while the infant is pressed against the body of the user using the main body 110.

Furthermore, the user may bind the plurality of shoulder straps 120 to each other using the first adjustment strap 121*c* and the second adjustment strap 122*c*. The receiving fastener 121*d* may be disposed on an end of the first adjustment strap 121*c*. The inserting fastener 122*d* may be disposed on an end of the second adjustment strap 122*c*. Additionally, the user may insert the inserting fastener 122*d* into the receiving fastener 121*d* to removably connect the first adjustment strap 121*c* to the second adjustment strap 122*c*. Also, inserting the inserting fastener 122*d* into the receiving fastener 121*d* may reduce movement of the plurality of shoulder straps 120, such that the plurality of shoulder straps may not fall off at least one of the shoulders of the user and cause the infant to fall out of the main body 110. As such, the second adjustment strap 122*c* may be removably connected to the first adjustment strap 121*c*.

The back strap 130 may be wrapped around a back of the user and over at least a portion of the first side 110*a* of the main body 110 to reduce strain on the user from wearing the infant holster 100. In other words, the back strap 130 may be attached to the user by wrapping in a circumference around the back and a front of the user and tied on a portion of the back strap 130 to fasten the back strap 130. As such, the plurality of shoulder straps 120 and the back strap 130 may redistribute weight of the infant across multiple portions of the body of the user, such as the back, hips, and the shoulders.

Therefore, the infant holster 100 may permit the user and the infant to enjoy the water environment together without worry of water collecting within at least a portion of the infant holster 100. Furthermore, the infant holster 100 may allow the user and the infant to move their limbs freely with minimal restrictions. As such, the user may carry the infant using the infant holster 100 without using a hand and/or an arm.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An infant holster for carrying an infant on a portion of a body of a user in a water environment, the infant holster comprising: a main body to brace the infant against at least a portion of the body of the user, the main body comprising: a mesh pouch disposed on at least a center portion of the main body to permit water to flow in and out of the main body, a top flap disposed along at least a portion of an edge of the main body to receive a head of the infant thereupon; a plurality of shoulder straps disposed along at least a portion of a top edge of the top flap to suspend the main body in response to wearing the plurality of shoulder straps on shoulders of the user; a back strap disposed on at least a portion of the top flap and having an end configured to wrap around a back and a front of the user, such that the back strap redistributes a weight of the infant within the main body across at least a portion of the body of the user; wherein each of the plurality of shoulder straps comprises: a first lower shoulder strap disposed on a portion of each of the plurality of shoulder straps; a second lower shoulder strap disposed on at least a portion of the main body to connect to the first lower shoulder strap to adjustably secure the infant against the body of the user; and wherein each of the plurality of shoulder straps further comprises: a fastener disposed between the first lower shoulder strap and the second lower shoulder strap to receive at least a portion of the first lower shoulder strap and at least a portion of the second lower shoulder strap therein, such that a length of each of the plurality of shoulder straps shortens in response to moving the first lower shoulder strap through the fastener in a first direction, and extends in response to moving the first lower shoulder strap through the fastener in a second direction.

2. The infant holster of claim 1, wherein the main body further comprises:

a trim edge disposed around a perimeter of the main body to support the mesh pouch.

3. The infant holster of claim 1, wherein the plurality of shoulder straps comprises:

a first shoulder strap to be worn on at least a portion of a first shoulder of the user; and a second shoulder strap to be worn on at least a portion of a second shoulder of the user.

4. The infant holster of claim 3, wherein the plurality of shoulder straps further comprises:

a first adjustment strap disposed on at least a portion of the first shoulder strap; and a second adjustment strap disposed on at least a portion of the second shoulder strap to connect to the first adjustment strap to reduce movement of the first shoulder strap and the second shoulder strap, such that the plurality of shoulder straps do not fall off at least one of the shoulders of the user and cause the infant to fall out of the main body.

5. The infant holster of claim 4, wherein the plurality of shoulder straps further comprises:

a receiving fastener disposed on an end of the first adjustment strap; and an inserting fastener disposed on an end of the second adjustment strap to removably connect the first adjustment strap to the second adjustment strap, such that the inserting fastener is inserted into the receiving fastener.

* * * * *